US005211721A

United States Patent [19]

Sung et al.

[11] Patent Number: 5,211,721

[45] Date of Patent: May 18, 1993

[54] POLYOXYALKYLENE ESTER COMPOUNDS AND ORI-INHIBITED MOTOR FUEL COMPOSITIONS

[75] Inventors: Rodney L. Sung, Fishkill; Daniel T. Daly, Brewster, both of N.Y.

[73] Assignee: Texaco Inc., White Plains, N.Y.

[21] Appl. No.: 730,134

[22] Filed: Jul. 15, 1991

Related U.S. Application Data

[63] Continuation of Ser. No. 660,069, Feb. 25, 1991, abandoned.

[51] Int. Cl.[5] ..... C10L 1/18

[52] U.S. Cl. ..... 44/389; 44/400; 560/186

[58] Field of Search ..... 44/391, 389, 400, 403; 560/186, 179, 183, 55, 60

[56] References Cited

U.S. PATENT DOCUMENTS

| | | | |
|---|---|---|---|
| 2,782,240 | 2/1957 | Hefner | 260/613 |
| 2,841,479 | 7/1958 | Hefner et al. | 44/447 |
| 3,047,373 | 7/1962 | McGuire | 44/66 |
| 3,144,311 | 8/1964 | Armstrong et al. | 44/340 |
| 3,146,203 | 8/1964 | Frew, Jr. | 252/49.9 |
| 3,438,757 | 4/1969 | Honnen et al. | 44/335 |
| 3,502,451 | 3/1970 | Moore et al. | 44/459 |
| 3,535,307 | 10/1970 | Moss et al. | 260/209 |
| 3,654,370 | 4/1972 | Yeakey | 260/584 B |
| 4,127,490 | 11/1978 | Newkirk et al. | 252/8.9 |
| 4,191,537 | 3/1980 | Lewis et al. | 560/158 |
| 4,198,306 | 4/1980 | Lewis | 252/51.5 A |
| 4,316,991 | 2/1982 | Speranza et al. | 568/609 |
| 4,357,148 | 11/1982 | Graiff | 44/432 |
| 4,548,616 | 10/1985 | Sung et al. | 44/447 |
| 4,551,152 | 11/1985 | Sung | 252/403 |
| 4,561,861 | 12/1985 | Davis et al. | 252/308 |
| 4,617,026 | 10/1986 | Shaub | 44/388 |
| 4,659,336 | 4/1987 | Sung et al. | 44/347 |
| 4,659,337 | 4/1987 | Sung | 44/347 |
| 4,747,851 | 5/1988 | Sung et al. | 564/505 |
| 4,758,247 | 7/1988 | Sung | 564/123 |
| 4,810,261 | 3/1989 | Sung et al. | 528/340 |

FOREIGN PATENT DOCUMENTS 2002675 5/1990 Canada .

OTHER PUBLICATIONS

*Kirk-Othmer, Encyclopedia of Chemical Technology*, 3rd Ed., vol. 18 John Wiley & Sons, N.Y. 1982 pp. 633-641.

*Primary Examiner*—Margaret Medley
*Attorney, Agent, or Firm*—James J. O'Loughlin

[57] ABSTRACT

Motor fuel compositions comprising gasoline are improved to control octane requirement increase (ORI) by including an ester of a carboxylic acid and a polyether polyol, preferably a polyether polyol including oxyethylene, oxypropylene and oxybutylene segments.

7 Claims, No Drawings

POLYOXYALKYLENE ESTER COMPOUNDS AND ORI-INHIBITED MOTOR FUEL COMPOSITIONS

This is a streamlined continuation of application Ser. No. 660,069, filed Feb. 25, 1991, now abandoned.

BACKGROUND OF THE INVENTION

1. Field of the Invention

The invention relates to novel gasoline-soluble polyoxyalkylene ester compounds, to concentrates comprising the polyoxyalkylene esters dissolved in hydrocarbon solvents and to haze-free, ORI-inhibited and deposit-resistant motor fuel compositions comprising the polyoxyalkylene esters.

Motor fuel compositions comprising the polyoxyalkylene esters of the instant invention are haze-free, ORI-inhibited and have a reduced tendency to form deposits.

2. Information Disclosure Statement

Combustion of a hydrocarbonaceous motor fuel in an internal combustion engine generally results in the formation and accumulation of deposits on various parts of the combustion chamber as well as on the fuel intake and exhaust systems of the engine. The presence of deposits in the combustion chamber seriously reduces the operating efficiency of the engine. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs, which causes engine knock. In addition the accumulation of deposits within the combustion chamber reduces the volume of the combustion zone, causing a higher than design compression ratio in the engine. This, in turn, also results in serious engine knocking. A knocking engine does not effectively utilize the energy of combustion. Moreover, a prolonged period of engine knocking will cause stress fatigue and wear in vital parts of the engine. The above-described phenomenon is characteristic of gasoline powered internal combustion engines. It is usually overcome by employing a higher octane gasoline for powering the engine, and hence has become known as the engine octane requirement increase (ORI) phenomenon. It would therefore be highly advantageous if engine ORI could be substantially reduced or eliminated by preventing deposit formation in the combustion chamber of the engine.

An additional problem common to internal combustion engines relates to the accumulation of deposits in the carburetor which tend to restrict the flow of air through the carburetor at idle and at low speed, resulting in an over rich fuel mixture. This condition also promotes incomplete fuel combustion and leads to rough engine idling and engine stalling. Excessive hydrocarbon and carbon monoxide exhaust emissions are also produced under these conditions. It would therefore be desirable from the standpoint of engine operability and overall air quality to provide a motor fuel composition which minimizes or overcomes the above-described problems.

Deposit-inhibiting additives for use in motor fuel compositions are well known in the art. However, conventional additives may cause hazing of the motor fuel. Hazy motor fuels are unacceptable by the public since they may indicate a problem with the fuel, such as the presence of undesired contaminants. It would therefore be desirable to provide a haze-free motor fuel composition which is deposit-resistant and ORI-inhibited.

In recent years, numerous fuel detergents or "deposit control" additives have been developed. These materials when added to hydrocarbon fuels employed internal combustion engines effectively reduce deposit formation which ordinarily occurs in carburetor ports, throttle bodies, venturis, intake ports and intake valves. The reduction of these deposit levels has resulted in increased engine efficiency and a reduction in the level of hydrocarbon and carbon monoxide emissions.

A complicating factor has, however, recently arisen. With the advent of automobile engines that require the use of non-leaded gasolines (to prevent disablement of catalytic converters used to reduce emissions), it has been difficult to provide gasoline of high enough octane to prevent knocking and the concomitant damage which it causes. The difficulty is caused by octane requirement increase, herein called "ORI", which is due to deposits formed in the combustion chamber while the engine is operating on commercial gasoline.

The basis of the ORI problem is as follows: each engine, when new, requires a certain minimum octane fuel in order to operate satisfactorily without pinging and/or knocking. As the engine is operated on any gasoline, this minimum octane increases and, in most cases, if the engine is operated on the same fuel for a prolonged period will reach equilibrium. This is apparently caused by an amount of deposits in the combustion chamber. Equilibrium is typically reached after 5000 to 15,000 miles of automobile operation.

Octane requirement increase measured in particular engines with commercial gasolines will at equilibrium vary from 5 or 6 octane units to as high as 12 or 15 units, depending upon the gasoline compositions, engine design and type of operation. The seriousness of the problem is thus apparent. The ORI problem exists in some degree with engines operated on leaded fuels. U.S. Pat. Nos. 3,144,311 and 3,146,203 disclose lead-containing fuel compositions having reduced ORI properties.

It is believed, however, by many experts, that the ORI problem, while present with leaded gasolines, is much more serious with unleaded fuel because of the different nature of the deposits formed with the respective fuels, the size of increase, and because of the lesser availability of high-octane non-leaded fuels. This problem is compounded by the fact that the most common means of enhancing the octane of unleaded gasoline, increasing its aromatic content, also appears to increase the eventual octane requirement of the engine. Furthermore, some of the presently used nitrogen-containing deposit control additives with mineral oil or polymer carriers appear to contribute significantly to the ORI of engines operated on unleaded fuel.

It is, therefore, highly desirable to provide fuel compositions which contain deposit control additives which effectively control deposits in intake systems (carburetor, valves, etc.) of engines operated with fuels containing them, but do not contribute to the combustion chamber deposits which cause increased octane requirements.

Co-assigned U.S. patent application Ser. No. 000,230, filed Jan. 1, 1987, now abandoned, discloses a novel gasoline-soluble reaction product and the use of the reaction product as an ORI-inhibitor in motor fuel compositions. The novel reaction product is obtained by reacting:

(i) about 1 mole of a dibasic acid anhydride;
(ii) 1–2 moles of novel polyoxyalkylene diamine; and
(iii) 1–2 moles of a hydrocarbyl polyamine.

Co-assigned U.S. Pat. No. 4,581,040 teaches the use or a reaction product as a deposit inhibitor additive in fuel compositions. The reaction product taught is a condensate product of the process comprising;

(i) reacting a dibasic acid anhydride with a polyoxyisopropylenediamine of the formula $$NH_2-\underset{\underset{CH_3}{|}}{CH}-CH_2-(OCH_2\underset{\underset{CH_3}{|}}{CH})_x-NH_2$$

where x is a numeral of about 2–50, thereby forming a maleamic acid;

(ii) reacting said maleamic acid with a polyalkylene polyamine, thereby forming a condensate product; and (iii) recovering said condensate product.

Co-assigned U.S. Pat. No. 4,639,336 discloses the use of the mixture of:

(i) the reaction product of maleic anhydride, a polyether polyamine containing oxyethylene and oxypropylene ether moieties, and a hydrocarbyl polyamine; and (ii) a polyolefin polymer/copolymer as an additive in motor fuel compositions to reduce engine ORI.

Co-assigned U.S. Pat. No. 4,659,337 discloses the use of the reaction product of maleic anhydride, a polyether polyamine containing oxyethylene and oxypropylene ether moieties, and a hydrocarbyl polyamine in a gasoline motor fuel to reduce engine ORI and provide carburetor detergency.

U.S. Pat. No. 4,604,103 discloses a motor fuel deposit control additive for use in internal combustion engines which maintains cleanliness of the engine intake systems without contributing to combustion chamber deposits or engine ORI. The additive disclosed is a hydrocarbyl polyoxyalkylene polyamine ethane of molecular weight range 300–2500 having the formula $$R-(OCH_2\underset{\underset{R'}{|}}{CH})_x-OCH_2CH_2-NR''R'''$$

where R is a hydrocarbyl radical of from 1 to about 30 carbon atoms; R′ is selected from methyl and ethyl; x is an integer from 5 to 30; and R″ and R‴ are independently selected from hydrogen and $-(CH_2CH_2NH-)_yH$ where y is an integer from 0–5.

U.S. Pat. No. 4,357,148 discloses the use of the combination of an oil-soluble aliphatic polyamine component containing at least one olefinic polymer chain and having a molecular weight range of 600–10,000 and a polymeric component which may be a polymer, copolymer, hydrogenated polymer or copolymer, or mixtures thereof having a molecular weight range of 500–1500 to reduce or inhibit ORI in motor fuels.

U.S. Pat. No. 4,191,337 discloses the use of hydrocarbyl polyoxyalkylene aminocarbonate, having a molecular weight range of 600–10,000 and also having at least one basic nitrogen atom per aminocarbonate molecule, to reduce and control ORI in motor fuels.

Co-assigned U.S. Pat. No. 3,502,451 discloses the use of $C_2$–$C_4$ polyolefin polymers or hydrogenated polymers having a molecular weight range of 500–3500 in motor fuels to eliminate or reduce deposition on the intake valves and ports of an internal combustion engine.

U.S. Pat. No. 3,438,757 discloses the use of branched chain aliphatic hydrocarbyl amines and polyamines having molecular weights in the range of 425–10,000 to provide detergency and dispersancy in motor fuels.

Co-assigned Rep. of South Africa Appl. No. 731,911, filed on Mar. 19, 1973, issued as Patent No. 73/1911 and now lapsed, discloses a motor fuel composition comprising a polymeric component which is a polymer or copolymeric component which is a polymer or copolymer of a $C_2$–$C_6$ unsaturated hydrocarbon having a molecular weight in the range of 500–3500, and a hydrocarbyl-substituted amine or polyamine component, said motor fuel composition having effectiveness in reducing engine intake valve and port deposits.

Co-assigned U.S. Pat. No. 4,316,991 discloses a modified polyol compound having a molecular weight range of 2000–7000, produced by reacting an initiator having an active hydrogen functionality of 3–4, one or more alkylene oxides, and an epoxy resin.

U.S. Pat. No. 3,654,370 discloses a method of preparing polyoxyalkylene polyamines by treating the corresponding polyoxyalkylene polyol with ammonia and hydrogen over a catalyst prepared by the reduction of a mixture of nickel, copper, and chromium oxides. The polyoxyalkylene polyamines formed are of the formula:

$$R-[(OCH_2\underset{\underset{X}{|}}{CH})_4-O\underset{\underset{Y}{|}}{CH}-\underset{\underset{Z}{|}}{CH}-NH_2)]_m$$

wherein R is the nucleus of an oxyalkylation-susceptible polyhydric alcohol containing 2–12 carbon atoms and 2–8 hydroxyl groups, Z is an alkyl group containing 1–18 carbon atoms, X and Y are hydrogen or Z, n has an average value of 0–50 and m is an integer of 2–8 corresponding to the number of hydroxyl groups in the polyhydric alcohol.

U.S. Pat. No. 3,535,307 discloses the preparation of high molecular weight polyether block copolymers by the sequential alkoxylation of a polyfunctional initiator with alkylene epoxide components.

As discussed above, despite the extensive efforts to control ORI phenomena, the increasing use of unleaded gasolines has created even greater demands for additives which are more effective in inhibiting or controlling ORI, particularly in engines operating on unleaded gasoline

SUMMARY OF THE INVENTION

It is an object of this invention to provide improved fuel additives for the control of ORI in gasoline engines, particularly those operating on unleaded gasoline.

It has been discovered that certain novel esters containing block copolymers with polyoxyalkylene backbones have utility in inhibiting carbonaceous deposit formation, motor fuel hazing, and as an ORI inhibitor when employed as a soluble additive in a motor fuel composition. The novel polyoxyalkylene ester compounds of the instant invention can be obtained by first preparing a polyoxyalkylene polyol by reacting a polyethylene glycol with ethylene oxide, propylene oxide, and butylene oxide, and thereafter reacting the polyol with a suitable organic acid R—COOH to form an ester, e.g. a diester, of the formula:

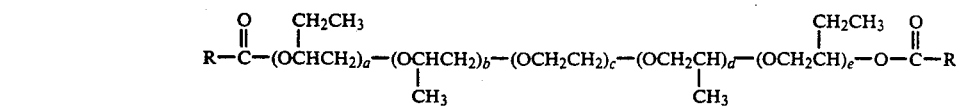

where c has a value from about 5–150, preferably 8–50, b+d has a value from about 5–150, preferably 8–50; and a+e has a value from about 2–12, preferably 4–8.

In other words, the gasoline ORI control additives of the present invention comprise a gasoline soluble ester of at least one carboxylic acid and a polyether polyol comprising repeating ether units including oxyethylene, oxypropylene and oxybutylene groups. Other oxyalkylene groups and alkylene groups can be present in the polyether segment, but these three principal oxyalkylene groups are sufficient.

Such esters can be represented by the simplified formula:

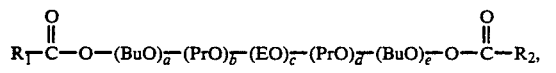

wherein BuO, PrO and EO represent oxybutylene, oxypropylene and oxyethylene groups, respectively, and $R_1$ and $R_2$ (which can be the same or different) are hydrocarbyl groups each having from 6 to about 27 carbon atoms, and the ester compound has a molecular weight of at least about 1300. In the above formula, the proportions of the various components can be approximately as indicated below:

a=1 to about 25 mole percent
b=1 to about 35 mole percent
c=1 to about 60 mole percent
d=1 to about 35 mole percent
e=1 to about 25 mole percent
b+e=1 to about 70 mole percent.

The invention also encompasses ester compounds in which reaction conditions are adjusted to leave some free hydroxyl groups and/or some hydroxyl groups capped by the formation of esters rather than forming diesters of each olyol molecule. Preferably, the proportions of the oxyalkylene components are within ranges such that a+e=5 to 10 mole percent, b+d=40 to 50 mole percent and c=45 to 50 mole percent.

The organic acid is selected with a hydrocarbyl group R (e.g. a long chain linear or branched hydrocarbyl group) such that the resulting ester compound is soluble in gasoline over the typical range of storage and use conditions.

The instant invention is also directed to a concentrate comprising about 10 to 75 weight percent, preferably from 15 to 35 weight percent, of the prescribed novel polyoxyalkylene ester dissolved in a hydrocarbon solvent, preferably xylene. In addition, the instant invention is directed to haze-free, deposit-resistant and ORI-inhibited motor fuel compositions comprising 0.005 to 0.2 weight percent, preferably 0.005 to 0.1, most preferably 0.01 to 0.1 weight percent of the prescribed reaction product. An additional polymer/copolymer additive with a molecular weight range of 500–3500, preferably 650–2600, may also be employed in admixture with the motor fuel composition of the instant invention in concentrations of about 0.001–1 weight percent, preferably about 0.01 to 0.5 weight percent.

DETAILED EMBODIMENTS OF THE INVENTION

The polyoxyalkylene ester compounds useful in the present invention can be described as esters of carboxylic acids and polyether polyols—that is, the reaction products of esterification reactions between such materials, or compounds containing moieties or residues of such carboxylic acids and polyether polyols which can be prepared by any suitable synthetic route.

In the broadest sense, these ester compounds comprise a polyether backbone and at least one ester linkage; free or non-esterified hydroxyl groups can be present as well. A preferred embodiment of the invention employs diesters, which can be prepared, e.g., by esterifying polyether dials.

The polyether polyol provides a polyether "backbone" for the molecule, and should have a molecular weight of at least about 700, preferably in the range of from about 700 to about 5000. To make the ester compounds effective as ORI reduction additives, the polyol should contain sufficient oxyalkylene groups having sufficient numbers of carbons (i.e., oxypropylene, but preferably oxybutylene) to make the compound gasoline soluble and contain sufficient oxygen to control ORI.

Generally, the oxyalkylene components of lower carbon number such as oxyethylene tend to produce higher proportions of oxygen to carbon in the ester compounds, while the oxyalkylene components of higher carbon number (such as oxybutylene) contribute to gasoline solubility at the expense of the oxygen to carbon ratio. The molar oxygen/carbon ratio in the ester compound has been found to be a measure of the potential effectiveness of the compound as an ORI control agent, as discussed below.

The polyols generally contain at least 2 hydroxyl groups, preferably from 2 to about 10. However, polyether alcohols which are monhydroxy compounds can also be employed, as discussed below.

The molecular weight of the polyol or alcohol should be at least about 700, preferably in the range from about 700 to about 5000, more preferably from about 1000 to about 4000, and most preferably from about 2000 to about 4000, and corresponding dicarboxylic and polycarboxylic species.

The carboxylic acids are generally those of the formula RCOOH, wherein R is an aliphatic hydrocarbyl group which is preferably substantially saturated. As used herein, the term "aliphatic hydrocarbyl group" denotes an aliphatic radical having a carbon atom directly attached to the remainder of the molecule and having predominantly hydrocarbon character within the context of this invention. "Substantially saturated" means that the group contains no acetylenic unsaturation and, for a group containing more than about 20 carbon atoms, at least about 95 percent of the carbon-to-carbon bonds therein are saturated. For groups containing about 20 carbon atoms or less, it means the presence of no more than two and usually no more than one olefinic bond. Suitable groups include the following:

1. Aliphatic groups (which are preferred).

2. Substituted aliphatic groups; that is, aliphatic groups containing non-hydrocarbon substituents which, in the context of this invention do not alter the predominantly hydrocarbon character of the group. Those skilled in the art will be aware of suitable substituents; examples are nitro, cyano,

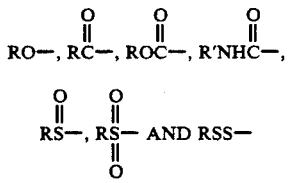

(R being a hydrocarbyl group and R' being hydrogen or a hydrocarbyl group).

3. Aliphatic hetero groups; that is, aliphatic groups which, while predominantly hydrocarbon in character within the context of this invention, contain atoms other than carbon present in a chaim otherwise composed of atoms. Suitable hetero atoms will be apparent to those skilled in the art and include, for example, oxygen, sulfur and nitrogen.

In general, no more than about three substituents or hetero atoms, and usually no more than one, will be present for each 10 carbon atoms in the aliphatic hydrocarbyl group.

Suitable acids have at least about 6 carbon atoms, preferably from about 12 to about 50 carbon atoms, and most preferably from about 16 to about 30 carbon atoms. Such acids have molecular weights of at least about 200, i.e., in the range of from about 200 to about 2000, preferably from about 200 to about 1000, and most preferably from about 400 to about 600.

In a preferred embodiment, certain N-acyl sarcosinates have been found effective as the acid component used to produce the ester compounds useful in the present invention, and several are exemplified herein. These materials are alkali metal salts (i.e., Na) prepared by reacting a fatty acid chloride and sarcosine, and can be represented by the formula:

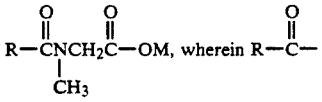

is an acyl group from a fatty acid having at least about 12 carbon atoms and M is an alkali metal ion or hydrogen. Such salts and the corresponding acids are sometimes identified by the acyl groups attached to the sarcosine, e.g., cocoyl sarcosine. Table A lists the trade names and some properties of such materials, which are available commercially from W. R. Grace Co., Organic Chemicals Division. These acids are presently preferred for preparation of the ester compounds of the present invention because they are commercially available at low cost. The single nitrogen to which the acyl group is attached may augment the surfactant effect of the ester compound, but is otherwise insignificant compared to the large hydrocarbyl component of the acyl group. These N-acyl sarcosinates also contribute more oxygen (in proportion to total carbon atoms) to the ester compounds than most conventional carboxylic acids.

TABLE A

| TRADE-NAME | RCO | M | # CARBONS | MOL. WEIGHT |
|---|---|---|---|---|
| Hamposyl C | cocoyl | H | 16 | 275–280 |
| Hamposyl L | lauroyl | H | 15 | 270–280 |
| Hamposyl M | myristoyl | H | 17 | 295–310 |
| Hamposyl O | oleoyl | H | 21 | 345–355 |
| Hamposyl S | stearoyl | H | 22 | 330–345 |

In certain preferred embodiments, dicarboxylic acids can be employed. Such acids can be represented by the formula:

$$R(COOH)_2,$$

where R is an aliphatic hydrobarbyl group similar to those described above for themonocarboxylic acids RCOOH. Such acids should have at least about 6 carbon atoms, preferably from about 6 to about 30 carbon atoms, and most preferably from about 16 to about 30 carbon atoms.

Preferred Poly(oxyalkylene) Components

The hydrocarbyl-terminated poly(oxyalkylene) polymers which can be utilized in preparing certain esters of the present invention can be monohydroxy compounds, i.e., alcohols, often termed monohydroxy polyethers, or polyalkylene glycol monohydrocarbylethers, or "capped" poly(oxyalkylene) glycols and are to be distinguished from the poly(oxyalkylene) glycols (diols), or polyols, which are not hydrocarbyl-terminated, i.e., not capped. The hydrocarbyl-terminated poly(oxyalkylene) alcohols are produced by the addition of lower alkylene oxides, such as oxirane, ethylene oxide, propylene oxide, the butylene oxides, or the pentylene oxides to a hydroxy compound ROH under polymerization conditions. Methods of production and properties of these polymers are disclosed in U.S. Pat. Nos. 2,841,479 and 2,782,240 and Kirk-Othmer's "Encyclopedia of Chemical Technology," Volume 19, p. 507. In the polymerization reaction a single type of alkylene oxide may be employed, e.g., propylene oxide, in which case the product is a homopolymer, e.g., a propylpoly(oxypropylene) alcohol. However, copolymers are equally satisfactory and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of the present invention. Random polymers are more easily prepared when the reactivities of the oxides are relatively equal. In certain cases, when ethylene oxide is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. A particular block copolymer is represented by a polymer prepared by polymerizing propylene oxide on a suitable monohydroxy compound to form a poly(oxypropylene) alcohol and then polymerizing butylene oxide on the poly(oxypropylene) alcohol.

In general, the poly(oxyalkylene) polymers are mixtures of compounds that differ in polymer chain length. However, their properties closely approximate those of the polymer represented by the average composition and molecular weight.

The hydrocarbylpoly(oxyalkylene) moiety, i.e., the polyether moiety, of the ester consists of a hydrocarbylpoly(oxyalkylene) polymer composed of oxyalkylene units, each containing from 2 to 5 carbon atoms. The polymer is bound to the ester via the ester linkage at the hydroxy-terminus of the poly(oxyalkylene) chain.

The hydrocarbyl group contains from 1 to about 30 carbon atoms. Preferably the oxyalkylene units contain from 3 to 4 carbon atoms and the molecular weight of the hydrocarbylpoly(oxyalkylene) moiety is from about 500 to about 5,000, more preferably from about 1,000 to about 2,500. Each poly(oxyalkylene) polymer contains at least about 5 oxyalkylene units, preferably 8 to about 100 oxyalkylene units, more preferably about 10–100 units and most preferably 10 to about 25 such units. In general, the oxyalkylene units may be branched or unbranched. Preferably the poly(oxyalkylene) polymer chain contains at least some $C_3$–$C_5$ oxyalkylene units, more preferably branched $C_3$–$C_5$ oxyalkylene units are present in at least sufficient number to render the hydrocarbyl-terminated poly(oxyalkylene) ester soluble in the fuel compositions of the present invention. This solubility condition is satisfied if the ester is soluble in hydrocarbons boiling in the gasoline range, at least to the extent of about 30–20,000 ppm by weight. A poly(oxyalkylene) polymer chain comprising oxyethylene units and branched three and/or four carbon oxyalkylene units in at least sufficient amount to effect solubility in the fuel or lube composition is most preferred. The structures of the $C_3$–$C_5$ oxyalkylene units are any of the isomeric structures well known to the organic chemist, e.g., n-propylene, $—CH_2CH_2CH_2—$; isopropylene, $—C(CH_3)CH_2—$; n-butylene, $—CH_2CH_2CH_2CH_2—$; tert-butylene, $—C(CH_3)_2CH_2$; disec.-butylene, $—CH(CH_3)CH(CH_3)—$; isobutylene, $—CH_2CH(CH_3)CH_2—$; etc. The preferred poly(oxyalkylene) compounds are composed, at least in part, of the branched oxyalkylene isomers, particularly oxy(isopropylene), and ox(sec.butylene) units which are obtained from 1,2-propylene oxide and from 1,2-butylene oxide, respectively.

The hydrocarbyl moiety (R) which terminates the poly(oxyalkylene) chain contains from 1 to about 30 carbons atoms, and is generally from the monohydroxy compound (ROH) which is the initial site of the alkylene oxide addition in the polymerization reaction. Such monohydroxy compounds are preferably aliphatic or aromatic of from 1 to about 30 carbon atoms, more preferably an alcohol or an alkylphenol, and most preferably an alkylphenol wherein the alkyl is a straight or branched chain of from 1 to about 24 carbon atoms. One such preferred alkyl group is obtained by polymerizing propylene to an average of 4 units and has the common name of propylene tetramer. The preferred material may be termed either an alkylphenylpoly(oxyalkylene) alcohol or a polyalkoxylated alkylphenol of from 7 to 30 carbon atoms.

A preferred novel polyoxyalkylene ester compound of the instant invention is a diester of the formula:

$$R—\overset{\overset{\displaystyle O}{\|}}{C}—[\overset{\overset{\displaystyle CH_2CH_3}{|}}{OCHCH_2}]_a—(\underset{\underset{\displaystyle CH_3}{|}}{OCHCH_2})_b—(OCH_2CH_2)_c—(\underset{\underset{\displaystyle CH_3}{|}}{OCH_2CH})_d—(\overset{\overset{\displaystyle CH_2CH_3}{|}}{OCH_2CH})_e—O—\overset{\overset{\displaystyle O}{\|}}{C}—R$$

where c has a value from about 5–150, preferably 8–50; b+d has a value from about 5–150, preferably 8–50; and a+e has a value from about 2–12, preferably 4–8. The prescribed polyoxyalkylene ester compound preferably contains a large number (5–150, preferably 8–50) of oxypropylene ether moieties in combination with a smaller number (2–12, preferably 4–8) of oxybutylene ether moieties.

Other ester compounds of the invention contain the same polyether "backbone" and a single ester linkage, the other ester linkage being replaced by at least one free hydroxyl group or ether group.

The novel polyoxyalkylene esters of the instant invention are obtained by first preparing a polyoxyalkylene (i.e. polyether) polyol and thereafter catalytically esterifying the polyol (at least partially) to produce the polyoxyalkylene ester. The polyether polyol is prepared by reacting an alkylene oxide or alkanol of an approximate molecular weight of 30 to 3000, preferably about 200, with an aqueous alkali metal hydroxide, preferably potassium hydroxide. The reactor is then supplied with a nitrogen gas purge and heated to about 95°–120° C., preferably about 100° C., and dried of water. Ethylene oxide is then charged into the reactor and reacted at a temperature of 95°–120° C., preferably 105°–110° C and a pressure of 10–100 psig, preferably about 50 psig. Without digestion, propylene oxide is then charged into the reactor and reacted at a temperature of 95°–120° C., preferably 105°–110° C.; and a pressure of 10–100 psig, preferably about 50 psig. Butylene oxide is then reacted at a temperature of 95°–120° C., preferably about 120° C., and a pressure of 10–100 psig., preferably about 50 psig. The resultant polyol contains oxyethlene, oxypropylene and oxybutylene ether moieties in combination, as described above.

After allowing for a digestion period, the alkaline polyol reaction product is neutralized with magnesium silicate, which may be added to the reaction mixture as a solid or as an aqueous slurry. A magnesium silicate particularly suitable for use in neutralizing the alkaline polyol is MAGNESOL 30/40, commercially available from Reagent Chemical and Research Inc. After neutralization, di-t-butyl-p-cresol is added to stabilize the polyol, and the polyol is thereafter stripped and filtered to yield the final polyol precursor compound. Esterification of the above-described polyol is accomplished as follows The polyol is allowed to react with a carboxylic acid at a temperature of about 80° C. to 100° C. in the presence of a suitable catalyst such as toluene sulfonic acid.

A critical feature of the preferred polyoxyalkylene compounds of the instant invention is the presence of a large number (5–150, preferably 8–50) of polyoxypropylene ether moieties in combination with more limited numbers (2–12, preferably 4–8) of polyoxybutylene ether moieties. In particular, the presence of a substantial number of polyoxypropylene ether and polyoxybutylene moieties enhances the gasoline solubility of the compound, thus increasing its efficacy as an additive in motor fuel compositions. The novel polyoxyalkylene ether compounds of the instant invention are advantageous over other ORI-controlling motor fuel additives such as those disclosed in U.S. Pat. Nos. 4,659,336 and 4,659,337, in that the instant invention is soluble in gasoline and similar motor fuel compositions, and therefore requires no admixing with a solvent prior to introduction into a base motor fuel composition. In addition, the presence of polyoxybutylene ether moieties in the instant invention has been found to prevent hazing in a motor fuel composition of the instant invention. An additional advantage compared with the various aminated polyoxyalkylene additives of the prior art is the expected elimination or reduction of nitrogen oxides emitted during combustion, due to the absence of the terminal amine groups present in the prior art additives. Nitrogen oxides are increasingly regarded as a serious environmental hazard.

In conjunction with gasoline solubility, it is desired to maximize the molar proportions of oxygen to carbon (i.e., the molar O/C ratio) in the ester compound to achieve the best effects of ORI reductions Since the carboxylic acids employed in producing the esters have relatively low O/C ratios (on the order of about 0.1 to 0 2) which will not vary appreciably among the acids which are employed, the overall O/C ratio for the ester compound will be determined primarily by the proportions of the polyoxyalkylene segments to the acid segments, and by the proportions of the various oxyalkylene groups. The overall molecular O/C ratios can be approximated by calculating a weighted average of the O/C ratios for the acid segments and the various oxyalkylene groups present, using the following ratios:

| UNIT | O/C RATIO |
|---|---|
| OXYALKYLENE UNIT | |
| Oxyethylene | 0.5 |
| Oxypropylene | 0.33 |
| Oxybutylene | 0.25 |
| ACID UNIT | |
| 6 Carbon atoms | 0.33 |
| 10 Carbon atoms | 0.2 |
| 20 Carbon atoms | 0.1 |

and so on. For best effects, the gasoline-soluble ester should have an overall molecular O/C ratio of at least about 0.2, and preferably has a ratio in the range of from about 0.2 to about 0.4.

It is unexpected and surprising that the reaction product set forth by the instant invention is an effective ORI controlling agent and exhibits carburetor detergency properties when employed in minor amounts as an additive in motor fuels, since the polyoxyalkylene-based compounds used in the prior art for such purposes have included terminal amino groups or other nitrogenous groups.

It has also been found that certain specific reaction products of the instant invention, when added to a motor fuel composition, have utility in reducing engine hydrocarbon and carbon monoxide emissions from carbureted engines as compared with the level of such emissions when a motor fuel without such a reaction product additive is combusted.

A postulate mechanism for the above-demonstrated effectiveness of the reaction product of the instant invention as an ORI controlling motor fuel additive with carburetor detergency properties would be as follows. The reaction product is a highly polar compound, and this acts as a surface active agent when added to a motor fuel. The polarity of the reaction product tends to attract carbonaceous deposits located within the engine combustion chamber and in and around the carburetor, and the deposits are thus removed from the metal surfaces within the combustion chamber and in and around the carburetor. The removal of these deposits accounts for the ORI controlling and carburetor detergency properties of the reaction product set forth by the instant invention when it is employed as a motor fuel additive. Note that the above-postulated mechanism is given only as a possible mechanism and that the instant invention resides in the above-described reaction product and motor fuel compositions containing such a reaction product.

The motor fuel composition of the instant invention comprises a major amount of a base motor fuel and about 0.005 to about 0.2 weight percent, preferably 0.005 to 0.1 weight percent of the above-described reaction product. The fuel may also optionally comprise effective amounts of the below-described optional polymeric component. Preferred base motor fuel compositions are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 450° F. This base fuel may consist of straight chains or branched chains or paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention. An example of a motor fuel composition of the instant invention is set forth in Example IX below. In addition, the motor fuel composition may contain any of the additives generally employed in gasoline. Thus, the fuel composition can contain anti-knock compounds such as tetraethyl lead compounds, anti-icing additives, upper cylinder lubricating oils, and the like.

The motor fuel composition of the instant invention may additionally comprise a polymeric component, present in a concentration ranging from about 0.001 to 1 weight percent, preferably 0.01 to 0.5 weight percent, based on the total weight of the motor fuel composition. The polymeric component may be a polyolefin polymer, copolymer, or corresponding hydrogenated polymer or copolymer of a $C_2$–$C_6$ unsaturated hydrocarbon. The polymer component is prepared from mono-olefins and diolefins, or copolymers thereof, having an average molecular weight in the range from about 500–3500, preferably about 650–2600. Mixtures of olefin polymers with an average molecular weight falling within the foregoing range are also effective. In general, the olefin monomers from which the polyolefin polymer component is prepared are unsaturated $C_2$–$C_6$ hydrocarbons. Specific olefins which may be employed to prepare the polyolefin polymer components include ethylene, propylene, isopropylene, butylene, isobutylene, amylene, hexylene, butadiene, and isoprene. Propylene, isopropylene, butylene, and isobutylene are particularly preferred for use in preparing the polyolefin polymer components. Other polyolefins which may be employed are those prepared by cracking polyolefin polymer components. Other polyolefins which may be employed are those prepared by cracking polyolefin polymers or copolymers of high molecular weight to a polymer in the above-noted molecular weight range. Derivatives of the noted polymers obtained by saturating the polymers by hydrogenation are also effective and are a part of this invention. The word "polymers" is intended to include the polyolefin polymers and their corresponding hydrogenated derivatives.

The average molecular weight range of the polymer component is a critical feature. The polyolefin polymer, copolymer, or corresponding hydrogenated polymer or copolymer component may have an average molecular weight in the range from about 500–3500, preferably from about 650–2600. The most preferred polymer components for use in the instant invention are polypropylene with an average molecular weight in the range of about 750–1000, preferably about 800, and polyisobutylene with an average molecular weight in the range of about 1000–1500, preferably about 1300. The polymer component, if employed, enhances the ORI reduction of the instant invention, and additionally provides enhanced cleanliness at the engine intake valves and ports.

EXAMPLES

The following examples illustrate the preferred methods of preparing the reaction products of the instant invention. It will be understood that the following examples are merely illustrative, and are not meant to limit the invention in any way. In the examples, all parts are parts by weight unless otherwise specified.

EXAMPLE I

To a 500 ml three neck flask, 127.8 parts of polypropylene glycol of molecular weight 1000, 72.5 parts oleic acid and 0.4 parts of p-toluenesulfonic acid were charged. The mixture was heated under reduced pressure and $N_2$ was used to blow the water of esterification over until no more came over. The residue was analyzed by elemental analysis, infrared spectroscopy and nuclear magnetic resonance. The ester product had the structure:

$$CH_3-(CH_2)_7-\overset{H}{\overset{|}{C}}=\overset{H}{\overset{|}{C}}-(CH_2)_7-\overset{O}{\overset{\|}{C}}-O-(CH_2-\overset{CH_3}{\overset{|}{CH_2}}-O)_n-\overset{O}{\overset{\|}{C}}-(CH_2)_7-\overset{H}{\overset{|}{C}}=\overset{H}{\overset{|}{C}}-(CH_2)_7-CH_3$$

EXAMPLE II

To the 500 ml three neck flask, 166.2 parts of PED-3600 34.2 parts N-oleoyl sarcosinate and 0.8 parts of p-toluenesulfonic acid were charged and heated under reduced pressure under $N_2$ to blow $H_2O$ over to drive the reaction to completion. PED-3600 is the precursor polyol to the diamine JEFFAMINE ED-3600, having the structure below:

$$HO-(CH_2-\overset{CH_2CH_3}{\overset{|}{C}}-O)_a-(CH_2-\overset{CH_3}{\overset{|}{CH_2}}-O)_b-(CH_2-CH_2-O)_c-(OCH_2\underset{CH_3}{\underset{|}{CH}})_d-(CH_2-\overset{CH_2CH_3}{\overset{|}{CH_2}})_e-OH,$$

where a=5 mole percent, b+d=45 mole percent and c=50 mole percent.

The residue was analyzed by IR, NMR and elemental analysis. The product structure was:

$$[CH_3-(CH_2)_7-\overset{H}{\overset{|}{C}}=\overset{H}{\overset{|}{C}}-(CH_2)_7-C-N-CH_2C-O]_2\ [PED\text{-}3600],$$
$$CH_3$$

where [PED-3600] represents the esterified version of the polyol structure shown above.

EXAMPLE III

To a 500 ml three neck flask, 172.0 parts of PED 3600 (MW 3441), 28.0 parts of Hamposyl C acid (N-Cocoyl sarcosinate, MW 280.0) and 0.8 parts of p-toluene sulfonic acid were charged. The Hamposyl acids are described above, and in Table III. The mixture heated under reduced pressure and nitrogen was used to blow the water of esterification over until no more was noted. The residue was analyzed by IR, NMR and TGA, confirming the structure shown below in which [PED-3600] represents the esterified polyol:

$$[C_{11}H_{23}C-\underset{CH_3}{\underset{|}{N}}-CH_2-\overset{O}{\overset{\|}{C}}-O]_2\ [PED\text{-}3600]$$

EXAMPLE IV

To a 500 ml three neck flask, 172.4 parts of PED 3600 (MW 3441), 27.6 parts of Hamposyl L acid (MW 275) and 0.8 parts of p-toluene sulfonic acid were charged. The Hamposyl acids are described above, and in Table III. The mixture was heated under reduced pressure and nitrogen was used to blow the water of esterification over until no more was noted. The residue was analyzed by IR, NMR and TGA. The product structure was similar to that of Example III except for the different acyl group (lauroyl) of the Hamposyl acid.

EXAMPLE V

To a 500 ml three neck flask, 167.2 parts of PED 3600 (MW 3441), 32.8 parts of Hamposyl S acid (MW 337.5) and 0.8 parts p-toluene sulfonic acid were charged. The Hamposyl acids are described above, and in Table III. The mixture was heated under reduced pressure and nitrogen was used to blow the water of esterification over until no more was noted. The residue was analyzed by IR, NMR and TGA. The product structure was similar to that of Example III except for the acyl group (stearoyl) of the Hamposyl acid.

EXAMPLE VI

The efficacy of the reaction product of the instant invention as an ORI-controlling additive in motor fuel compositions has been demonstrated by subjecting the reaction products exemplified by Example I, and two commercially available fuel additives (OGA-480 and OGA-472, both available from Chevron Chemical Company) to Thermogravimetric Analysis (TGA). As discussed at Col. 12, lines 30–62 of U.S. Pat. No. 4,198,306 (Lewis), incorporated herein by reference, deposit control additives showing low TGA values, i.e. more rapid thermal decomposition, have been found to show low ORI values in laboratory engine tests. The results of the TGA tests are set forth below:

TABLE I

| Compound | Weight Remaining, (%) after 30 min. at 295° C.[1] |
|---|---|
| OGA-480[3] (Dialyzed to remove diluent oil) | 3.3 |
| OGA-472[2] (Dialyzed to remove diluent) | 64.6 |
| Example I | 13.78 |

[1]With a flow of 60 ml of air per minute.
[2]Indopol H-300 ®, or polyisobutylene (M. wt of 1290) and ethylenediamine.
[3]An alkyl ether carbamate amide.

It is well known to those skilled in the art that additive OGA-480 controls engine ORI, but that OGA-472 tends to cause engine ORI. From the above TGA data, Example I yielded a percentage TGA residue value slightly greater than OGA-480 but much less than OGA-472, and therefore should have corresponding ORI-controlling properties much greater than those of OGA-472 but comparable to OGA-480. Thus, the reaction product of the instant invention containing primarily oxypropylene in the backbone has ORI-controlling properties comparable to those of a commercially available additive (OGA-480).

EXAMPLES VII–IX

As in Example VI, the reaction product of Example II was compared with the additives OGA-480 and OGA-472 by TGA. The results of the TGA tests are set forth below:

TABLE II

| Compound | TGA Results: % Wt remaining after 30 min at 295° C. |
|---|---|
| OGA-480 | 3.3 |
| OGA-472 | 64.6 |
| Example II | 9.4 |

As the data in Table II demonstrate, the invention of Example II is comparable to OGA-480 in leaving a residue and can be expected to control ORI much the same as this additive.

EXAMPLE VIII

Reaction products were prepared from the polyol PED 3600 and selected fatty acids, as in Examples I and II, and subjected to TGA testing in comparison with the additives OGA-480 and OGA-472. The results are set forth in Table III below:

TABLE III (TGA TEST RESULTS)

| Example | Compound or Acid | % wt remaining after 30 minutes at 295° C. |
|---|---|---|
| Control | OGA-480 | 3.3 |
| Control | OGA-472 | 64.6 |
| VII | Bis hamposyl C[1] | 5.37 |
| VIII | Bis hamposyl L[1] | 4.62 |

TABLE III-continued (TGA TEST RESULTS)

| Example | Compound or Acid | % wt remaining after 30 minutes at 295° C. |
|---|---|---|
| IX | Bis hamposyl S[1] | 8.79 |

[1]See Table A.

As discussed above, the hamposyl acids are N-acyl sarcosinates represented by the formula:

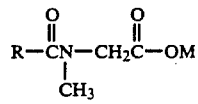

wherein

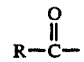

is an acyl group derived from a fatty acid. The letters C, L and S denote compounds in which the acyl groups are cocoyl, lauroyl and stearoyl, respectively.

As described in Examples VI and VII, these data indicate that the reaction products of the present invention should have ORI-controlling properties only slightly less than those of OGA-472.

HYPOTHETICAL EXAMPLE IX

30 PTB of the reaction product set forth in Example II (i.e. 30 pounds of reaction product per 1000 barrels of gasoline, equivalent to about 0.01 weight percent of reaction product based on the weight of the fuel composition) is blended with a major amount of a base motor fuel (herein designated as Base Fuel A) which is a premium grade gasoline essentially unleaded (less than 0.05 of tetraethyl lead per gallon), comprising a mixture of hydrocarbons boiling in the gasoline boiling range consisting of about 22 percent aromatic hydrocarbons, 11 percent olefinic carbons, and 67 percent paraffinic hydrocarbons, boiling in the range from about 90° F. to 450° F. Engine testing indicates that this additive reduces or eliminates ORI.

EXAMPLES X–XVII

It has also been found that a motor fuel composition comprising a minor amount of the reaction product composition of the instant invention is effective in minimizing and reducing gasoline internal combustion engine deposits. This is an improvement in the fuel performance which may reduce the incidence of engine knock. A motor fuel composition of the instant invention was tested by the Combustion Chamber Deposit Screening Test (CCDST). In this test, the deposit-forming tendencies of a gasoline are measured. The amount of deposit formation correlates well with the ORI performance observed in car tests and engine tests. The amount of deposit is compared to a high reference (a standard gasoline known to have a high deposit formation) and a low reference (an unleaded base fuel which is known to have a low deposit formation).

The CCDST determines whether the additive in question is effective as a deposit control additive to prevent ORI. In this test, the additive samples of reaction product based upon PED-3600 esterified with various acids were dissolved in Base Fuel A in a concentration of 100 PTB (100 pounds of additive per 1000 barrels of fuel, equivalent to about 0.033 weight percent of additive). In a nitrogen/hot air environment the gasoline was then atomized and sprayed onto a heated aluminum tube. After 100 minutes, the deposits which were formed on the tube were weighed. Gasolines which form larger amounts of deposits on the heated aluminum tube cause the greatest ORI when employed in an internal combustion engine. The CCDST was also employed to measure the deposit tendencies of a high reference fuel (Examples H), known to yield a large deposit, and a low reference fuel (Examples L), a standard unleaded gasoline known to yield a low deposit. The results are summarized below in Table IV.

TABLE IV (CCDST RESULTS)

| Example | Acid Reactant | Deposit Remaining (mg) High(H) | Low(L) | Sample |
|---|---|---|---|---|
| X | Bisoleyl | 12.0 | 2.8 | 4.4 |
| XII | Bis hamposyl C | 12.0 | 2.5 | 4.3 |
| XIII | Bis hamposyl L | 12.0 | 2.8 | 4.1 |
| XIV | Bis hamposyl M[1] | 12.0 | 2.5 | 5.5 |
| XV | Bis hamposyl O[2] | 16.0 | 2.5 | 6.0 |
| XVI | Bis hamposyl S | 16.0 | 2.5 | 9.1 |
| XVII | Bis Kort acid[3] | 12.0 | 2.8 | 7.5 |

[1]The hamposyl acid as described in footnote 1 of Table II, with a myristoyl acyl group.
[2]The hamposyl acid as described above, with an oleoyl acyl group.
[3]A carboxylic acid having the structure:

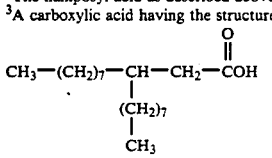

The above results illustrate that the motor fuel compositions of the instant invention were slightly superior to the low reference unleaded base fuel, in terms of resistance to deposit formation, and consequently in terms of ORI-inhibition.

For convenience in shipping and handling, it is useful to prepare a concentrate of the reaction product of the instant invention. The concentrate may be prepared in a suitable liquid hydrocarbon solvent such as toluene or xylene, with approximately 10 to 75, preferably 15 to 35, weight percent of the reaction product of the instant invention blended with a major amount of the liquid solvent, preferably xylene.

Motor fuel and concentrate compositions of the instant invention may additionally comprise any of the additives generally employed in motor fuel compositions. Thus, compositions of the instant invention may additionally contain conventional carburetor detergents, anti-knock compounds such as tetraethyl lead compounds, anti-icing additives, upper cylinder lubricating oils and the like. In particular, such additional additives may include compounds such as polyolefin polymers, copolymers, or corresponding hydrogenerated polymers or copolymers of $C_2$–$C_6$ unsaturated hydrocarbons, or mixtures thereof. Additional additives may include substituted or unsubstituted monoamine or polyamine compounds such as alkylamines, ether amines, and alkylalkylene amines or combinations thereof.

It will be evident that the terms and expressions employed herein are used as terms of description and not of limitation. There is no intention, in the use of these descriptive terms and expressions, of excluding equivalents of the features described and it is recognized that various modifications are possible within the scope of the invention claimed.

The invention claimed is:

1. An oil soluble polyether ester additive comprising the reaction product of a polyether polyol represented by the formula:

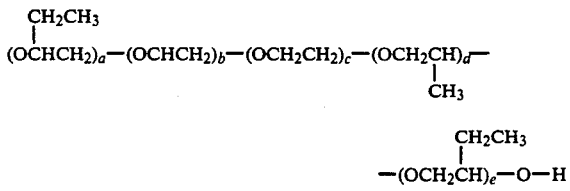

in which c has a value from about 5–150, b+d has a value from about 5–150, and a+e has a value from about 2–12, with an acid represented by the formula RCOOH in which R is a hydrocarbyl radical having from 6 to 27 carbon atoms.

2. An additive according to claim 1 in which the formula RCOOH represents the fatty acid from the group consisting of oleic acid and stearic acid.

3. An additive according to claim 1 in which said ester is a diester.

4. An additive according to claim 1 in which c has a value from 8–50, b+d has a value from 8–50, and a+e has a value from 4–8.

5. An additive according to claim 1 in which said polyether polyol has a molecular weight in the range from about 1000 to about 4000.

6. An additive according to claim 1 in which said polyether polyol has a molecular weight in the range from about 2000 to about 4000.

7. A motor fuel composition comprising a mixture of hydrocarbons falling in the range from about 90° F. to 450° F., and an effective amount of the additive of claim 1 to impart haze-free, ori-inhibited and deposit-resistant properties to said motor fuel composition.

* * * * *